US007035565B2

(12) United States Patent
Takahashi et al.

(10) Patent No.: US 7,035,565 B2
(45) Date of Patent: Apr. 25, 2006

(54) IMAGE PRINTING APPARATUS INCLUDING A SEPARATE FIXING UNIT CONTROL SECTION

(75) Inventors: Atsushi Takahashi, Tokyo (JP); Norio Joichi, Tokyo (JP); Yuhou Bou, Tokyo (JP); Yoshihito Sasamoto, Tokyo (JP); Akifumi Isobe, Tokyo (JP); Yoshiki Katayama, Tokyo (JP)

(73) Assignee: Konica Minolta Holdings, Inc., Tokyo (JP)

( * ) Notice: Subject to any disclaimer, the term of this patent is extended or adjusted under 35 U.S.C. 154(b) by 186 days.

(21) Appl. No.: 10/761,458

(22) Filed: Jan. 20, 2004

(65) Prior Publication Data

US 2004/0151516 A1 Aug. 5, 2004

(30) Foreign Application Priority Data

Jan. 28, 2003 (JP) ..... 2003-018565

(51) Int. Cl.
*G03C 15/00* (2006.01)
*G03C 15/20* (2006.01)

(52) U.S. Cl. ..... 399/70; 399/67; 399/75; 399/82

(58) Field of Classification Search ..... 399/82, 399/67, 69, 70, 75, 76, 320; 347/156
See application file for complete search history.

(56) References Cited

U.S. PATENT DOCUMENTS

| | | | | |
|---|---|---|---|---|
| 4,996,567 | A * | 2/1991 | Watarai et al. | 399/70 |
| 5,749,022 | A * | 5/1998 | Kikui et al. | 399/50 |
| 6,405,000 | B1 * | 6/2002 | Nakaya | 399/67 |
| 2003/0142989 | A1 * | 7/2003 | Kobayashi | 399/75 |

FOREIGN PATENT DOCUMENTS

JP 2000-132042 A 5/2000

* cited by examiner

*Primary Examiner*—Sophia S. Chen
(74) *Attorney, Agent, or Firm*—Frishauf, Holtz, Goodman & Chick, P.C.

(57) ABSTRACT

This invention is directed to an image printing apparatus having a fixing control section which controls a fixing unit for fixing a toner image on a paper sheet by applying pressure and heat. The image printing apparatus of this invention includes, in the fixing control section, an interface which can receive data from an external data input device so as to shorten the warmup time of the fixing unit and perform direct instructing operation from the data input device to the fixing-unit.

12 Claims, 7 Drawing Sheets

IMAGE PRINTING APPARATUS INCLUDING A SEPARATE FIXING UNIT CONTROL SECTION

BACKGROUND OF THE INVENTION

1. Field of the Invention

The present invention relates to an image printing apparatus such as a copying machine, printer, or facsimile apparatus, which forms a toner image by electrophotography and has a fixing unit which fixes the toner image on a paper sheet by applying pressure and heat.

2. Description of the Prior Art

An image printing apparatus based on electrophotography has a fixing unit which pressurizes and heats a paper sheet carrying a toner image while conveying the paper sheet by a pair of rollers to fix the toner image on the paper sheet. A heating roller used for this fixing unit incorporates a heater, and is heated when the heater is energized. The surface temperature of this heating roller is monitored by a temperature sensor. The heating roller is heated up to a predetermined temperature suitable for fixing operation on the basis of the obtained temperature information. Thereafter, the roller is maintained at the predetermined temperature by controlling power to be applied to the heater.

It generally takes several ten seconds to several minutes for the temperature of a heating roller to rise, upon energization of the heater, from room temperature to a temperature suitable for fixing operation. This period of time has been the wait time between the instant at which the power supply of an image printing apparatus is turned on and the instant at which the apparatus is set in an operable condition.

Recently, in order to perform control in accordance with an improvement in the function of an image printing apparatus, the control section of the apparatus body is formed by a computer system having a microcomputer as a main component. When the input power supply of the image printing apparatus is turned on, a power supply for supplying constant-voltage power to the control section is turned on. The control section then outputs a necessary reset signal to download a program stored in the memory of the control section into an area for the execution of the program by a small program loader called IPL or bootstrap. Starting the execution of this program will start predetermined control operation. An increase in program size, however, increases the download time described above. As a consequence, it takes much time to start energization control on the fixing unit. That is, for the user, this further increases the wait time between the instant at which the input power supply of the image printing apparatus is turned on and the instant at which the apparatus is set in an operable condition.

In order to solve this problem, a method of preventing an increase in wait time has also been proposed, which achieve this purpose by storing a fixing unit control program in a memory different from a memory in which a program is stored, and executing the fixing unit control program during downloading of the program (see, for example, Japanese Unexamined Patent Publication No. 2000-132042, p. 2, lines 2–14).

However, permission/inhibition of energization for heating the fixing unit poses problems not only when the input power supply of the image printing apparatus is turned on but also in, for example, a manufacturing process in a factory and technical services on the market. In other words, it is not necessarily good to keep the heater energized regardless of the control unit which controls the image printing apparatus body.

SUMMARY OF THE INVENTION

The present invention has been made in consideration of the above situation, and has as its object to provide an image printing apparatus which has, in a fixing control section which controls a fixing unit, a communication interface for communication with other data input devices in addition to an interface for exchanging information with a control section of the image printing apparatus body, and can independently determine permission or inhibition of energization for temperature control by making reference to information sent from the data input device.

In order to achieve the above object, according to a first aspect of the present invention, there is provided an image printing apparatus, comprising: a fixing means which fixes a toner image transferred on a paper sheet to the paper sheet by applying pressure and heat; a fixing control means for controlling the fixing means; and an image printing control means for controlling printing of the toner image, wherein the fixing means has: an operation mode for starting energization of the fixing means after an initialization in the image printing control means is completed; and another operation mode for starting energization of the fixing means before an initialization in the image printing control means is completed.

According to a second aspect of the present invention, there is provided an image printing apparatus in which either one of the two operation modes described in the first aspect is performed at the time when electric power source of the image printing apparatus is turned on or at the time of returning from a stand-by state which is a low power consumption mode.

According to a third aspect of the present invention, there is provided an image printing apparatus, comprising: a fixing means which fixes a toner image transferred on a paper sheet to the paper sheet by applying pressure and heat; a fixing control means for controlling the fixing means; an image printing control means for controlling printing of the toner image; and an interface mounted on the fixing means and capable of receiving data from a data input means, wherein the fixing means has: an operation mode for starting energization of the fixing means by making reference to the data received through the interface from a data input means after an initialization in the image printing control means is completed; and another operation mode for starting energization of the fixing means before an initialization in the image printing control means is completed.

According to a fourth aspect of the present invention, there is provided an image printing apparatus in which either one of the two operation modes described in the third aspect is performed at the time when electric power source of the image printing apparatus is turned on or at the time of returning from a stand-by state which is a low power consumption mode.

According to a fifth aspect of the present invention, there is provided an image printing apparatus in which the data input means described in the third aspect is provided independently of the fixing means and is allowed to connect with the interface through a communication cable.

According to a sixth aspect of the present invention, there is provided an image printing apparatus in which the data input means described in the third aspect is mounted in an operation/display section of the image printing apparatus.

According to a seventh aspect of the present invention, there is provided an image printing apparatus in which the data inputted by the data input means described in the third aspect includes pieces of information in relation to at least a load individual operation mode, a process mode used in a manufacturing process, a service mode used upon an after-sale service.

According to an eighth aspect of the present invention, there is provided an image printing apparatus in which an image printing apparatus, comprising: a fixing means which fixes a toner image transferred on a paper sheet to the paper sheet by applying pressure and heat; a fixing control means for controlling the fixing means; an image printing control means for controlling printing of the toner image; and an interface mounted on the fixing means and capable of receiving data from a data input means, wherein the fixing means has: an operation mode for judging whether or not starting energization of the fixing means after an initialization in the image printing control means is completed; and another operation mode for judging whether or not starting energization of the fixing means before an initialization in the image printing control means is completed.

According to a ninth aspect of the present invention, there is provided an image printing apparatus in which either one of the two operation modes described in the eighth aspect is performed at the time when electric power source of the image printing apparatus is turned on or at the time of returning from a stand-by state which is a low power consumption mode.

According to a tenth aspect of the present invention, there is provided an image printing apparatus in which the data input means described in the eighth aspect is provided independently of the fixing means and is allowed to connect with the interface through a communication cable.

According to an eleventh aspect of the present invention, there is provided an image printing apparatus in which the data input means described in the eighth aspect is mounted in an operation/display section of the image printing apparatus.

According to a twelfth aspect of the present invention, there is provided an image printing apparatus in which the data inputted by the data input means described in the eighth aspect includes pieces of information in relation to at least a load individual operation mode, a process mode used in a manufacturing process, a service mode used upon an after-sale service.

As is obvious from the respective aspects described above., according to the present invention, the control section which controls the image printing apparatus body can independently start energization of the fixing unit regardless of the download time for a program to be executed when the power supply is turned on. This makes it possible to shorten the time interval between the instant at which the power supply is turned on and the instant at which the warming up of the fixing unit is complete. In addition, since permission/inhibition of energization can be externally designated through the data input device, a fixing unit suitable for an operation condition can be energized, thereby ensuring safety for operation.

The above and many other objects, features and advantages of the present invention will become manifest to those skilled in the art upon making reference to the following detailed description and accompanying drawings in which preferred embodiments incorporating the principle of the invention are shown by way of illustrative examples.

DETAILED DESCRIPTION OF THE PREFERRED EMBODIMENT

A preferred embodiment of the present invention will be described below with reference to the accompanying drawings.

Figure 1:
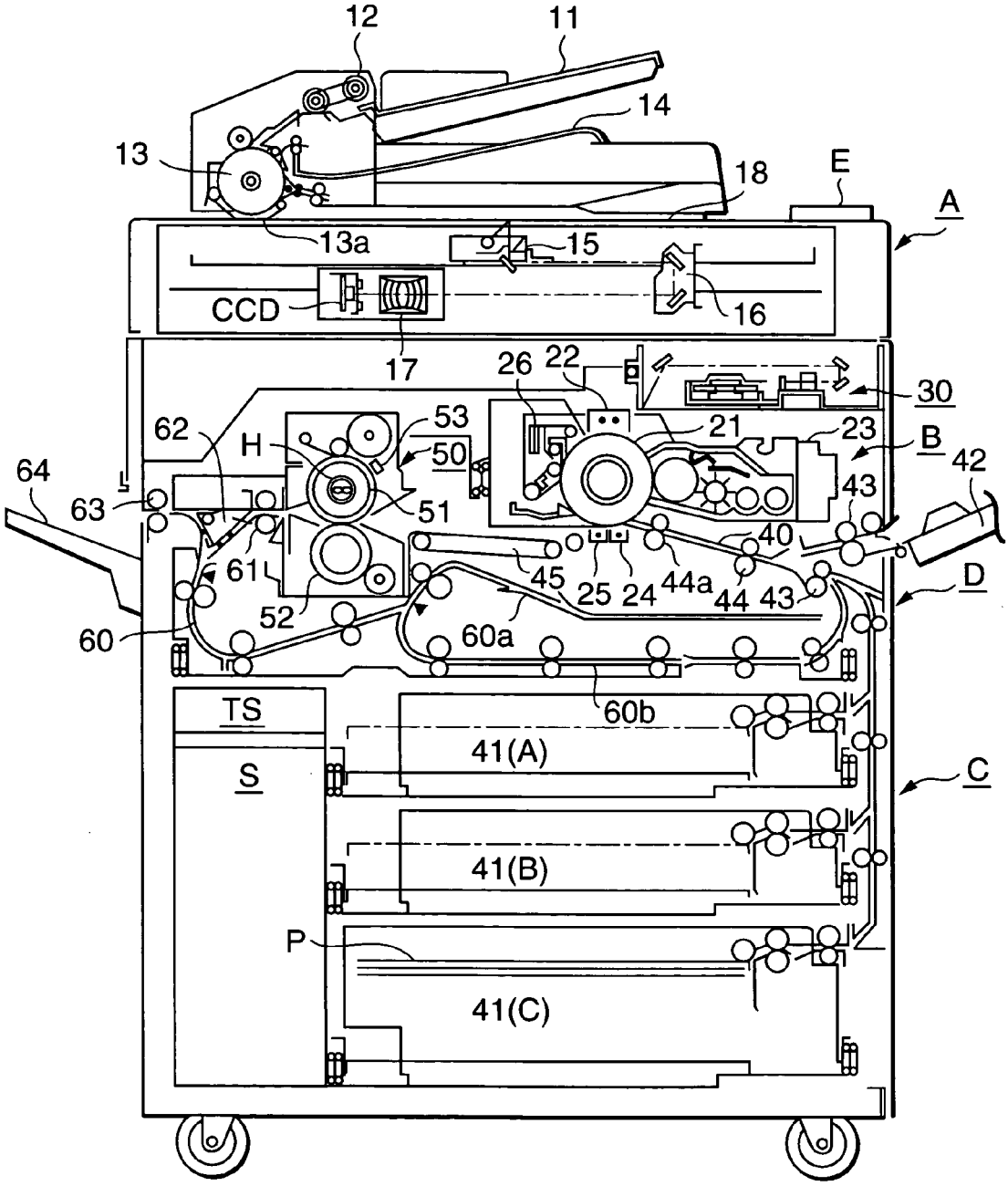
FIG. 1 is a schematic view showing the schematic arrangement of an image printing apparatus of the present invention.

The image printing apparatus shown in FIG. 1 is a so-called digital image printing apparatus, which includes an image reading section A, image printing section B, paper feed section C, and convey section D.

An automatic original feeding unit which automatically feeding originals is provided on the upper portion of the image reading section A. Originals (not shown) placed on an original table 11 are separated and fed to a convey path one by one by an original pickup roller 12 and conveyed by an original convey roller 13. An image on the original is then read, at a set position below a read position 13*a*, by a first mirror unit 15 constituted by an illumination lamp in a stop state and a first mirror, a second mirror unit 16 constituted by second and third mirrors arranged in the form of the letter "V", an imaging lens 17, and an image sensing device (CCD). The original from which an image has been read is delivered onto an original delivery tray 14 by the original convey roller 13.

When an original is placed on a platen glass 18, the first and second mirror units 15 and 16 which constitute a scanning optical system move in the horizontal direction to scan the original. The scanned original image is formed on the light-receiving surface of the image sensing device (CCD), which is a line sensor, through the imaging lens 17.

The optical information imaged on the image sensing device (CCD) is sequentially photoelectrically converted into an electrical signal. This signal is then A/D-converted by an image input control unit 300, and subjected to density conversion, filtering, and the like. The resultant data is temporarily stored as image data in the memory of a whole control section S.

In the image printing section B, a toner image is formed under the control of an image printing control unit 500 for the execution of a known electrophotographic process.

As shown in FIG. 1, a charging device 22, exposure device 30, developing device 23, transfer device 24, separating device 25, and cleaning device 26 are sequentially arranged around a drum-like photosensitive member 21 in accordance with the operation sequence. The photosensitive member 21 is obtained by coating the surface of a drum base member with a photoconductive compound. For example, an organic photoconductor (OPC) is used. This member is rotated clockwise.

An electrostatic latent image is formed on the surface of the rotating photosensitive member 21, which has been uniformly charged by the charging device 22, by image exposure performed by an image output control unit 400 which controls the exposure device 30 in accordance with the image information read out from the memory of the whole control section S.

The developing device 23 performs reversal development of the formed electrostatic latent image to form a visible toner image on the photosensitive layer of the photosensitive member 21. The paper feed section C having paper feed units 41(A), 41(B), and 41(C) in which paper sheets P having different sizes are stored, respectively, is placed below the image printing section B. A manual paper feed unit 42 for manually feeding paper sheets is provided on a side of the paper feed section C. The paper sheet P selected from one of these paper feed units is conveyed by convey rollers 43 along a paper feed path 40 and temporarily stopped by registration rollers 44 which correct skewing and offsetting of the paper sheet P. Thereafter, the paper sheet is fed toward the image printing section B. The fed paper sheet P is conveyed by pre-transfer rollers 44*a*, and the toner image on the photosensitive member 21 is transferred onto the paper sheet by the transfer device 24. The paper sheet P carrying the toner image is electrically discharged by the separating device 25 to be separated from the surface of the photosensitive member 21. The paper sheet is then conveyed to a fixing unit 50 by a convey device 45.

The fixing unit 50 has a heating roller 51 incorporating a heater H, a press roller 52, and a temperature sensor 53. The paper sheet P carrying the toner image is placed between the heating roller 51 and the press roller 52 to be conveyed while being pressed and heated, thereby fixing the toner image on the paper sheet P. The paper sheet P on which the toner image is completely fixed is directly delivered onto a delivery tray 64 in the single-sided image printing mode.

When the double-sided image printing mode is selected, the paper sheet P, which has undergone the image fixing operation on the surface and has been conveyed by fixing delivery rollers 61, passes below an inversion switching member 62, moves downward along an inversion convey path 60, and is temporarily conveyed into a switchback path 60*a*. The paper sheet P is then conveyed out of the switchback path 60*a*. As a result, the obverse and reverse surfaces of the paper sheet are inversed. Thereafter, the paper sheet is fed by the convey rollers 43 along the paper feed path 40 through a reverse surface feed path 60*b*, and is temporarily stopped by the registration rollers 44. The paper sheet is then re-fed. The toner image as a reverse surface image formed on the photosensitive member 21 is transferred onto the reverse surface of the re-fed paper sheet P by the transfer device 24. The paper sheet P separated from the photosensitive member 21 is delivered onto the delivery tray 64 through sheet delivering rollers 63, with the toner image on the reverse surface being fixed by the fixing unit 50.

Figure 2:
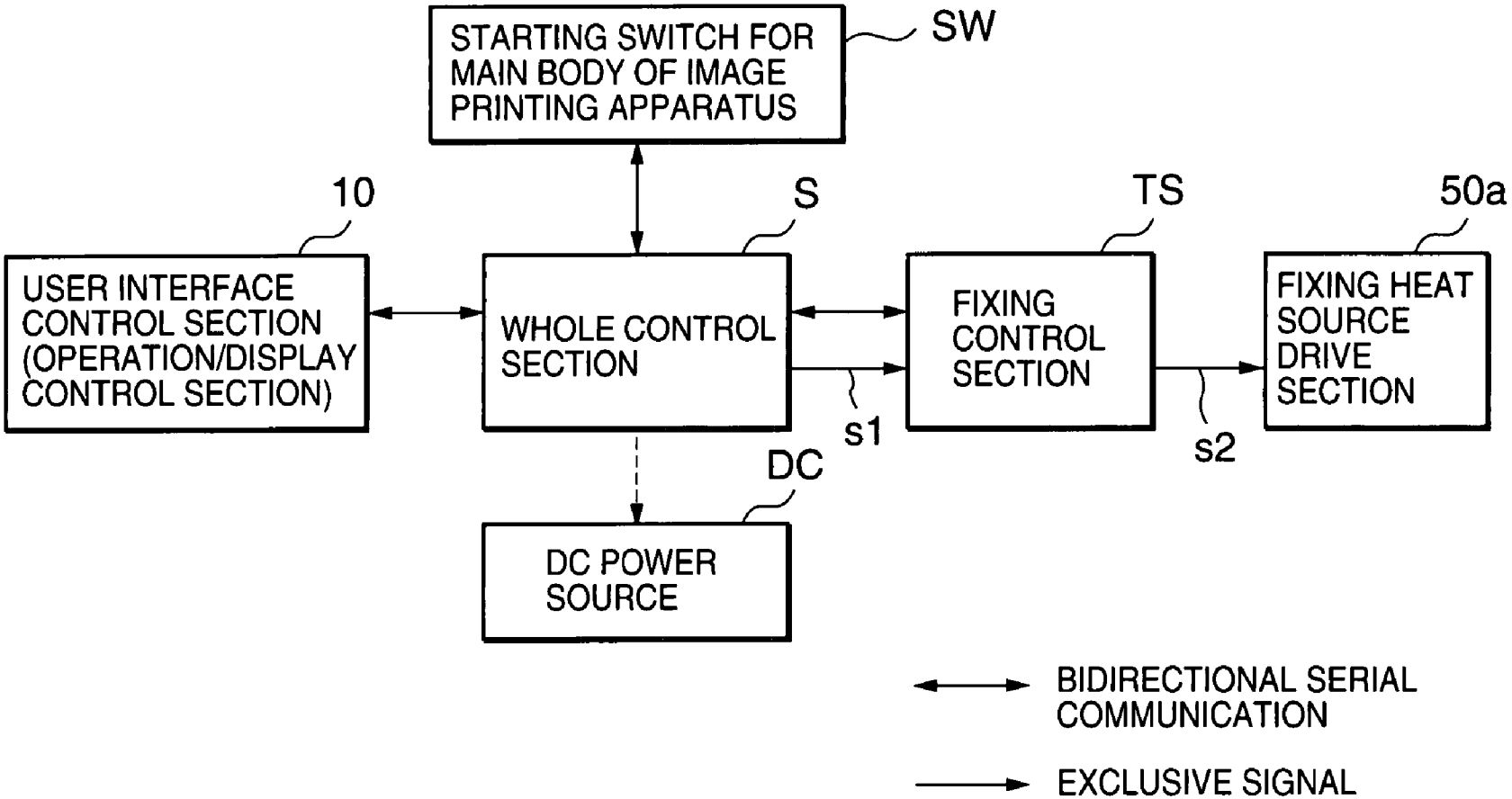
FIG. 2 is a block diagram showing the whole control system of a main part in the image printing apparatus of the present invention.

In FIG. 2, a whole control system in the image printing apparatus of the present invention is indicated. In FIG. 2, a user interface control section (an operation/display control section) 10 corresponds to, for example, an operation/display panel mounted on the image printing apparatus and operated by the user or a personal computer connected through the Internet to a whole control section S. A fixing control section TS performs a temperature control of a fixing portion and an ON/OFF control for the fixing heater H. In addition to the above composition elements, the whole control section S is provided with a starting switch SW for a main body of the image printing apparatus, a DC power source DC, an engine control section serving as the fixing control section TS, a fixing heat source drive section 50*a*, etc.

In the embodiment shown in FIG. 2, the fixing control is conducted by the engine control section which serves a paper sheet transfer control, etc., also. However, the present invention is not limited to this embodiment. In other words, the fixing control and the paper sheet transfer control can be carried out by their individual CPUs independent of each other, respectively, or a common CPU. Further, the engine control for the paper sheet transfer control and the fixing control, etc., can be carried out by their exclusive electric circuits, respectively.

The whole control section S controls whole sections of the image printing apparatus. For example, display in the operation/display section E, decision of function selected by the user in the operation/display section E, instruction to the image reading section, instruction to the engine section, ON/OFF control for a DC power source output, etc., are carried out by the whole control section S. In addition, various power modes (including an power saving mode), decision to start up the main body of the image printing apparatus (depressing the power source switch SW), decision of an operation mode, page management of image, memory management, management of data transferred from the outside, etc., are carried out by the whole control section S also.

Except for the DC power source DC and the fixing heat source drive section 50*a*, an input or output operation between respective composition elements of the whole control section S is conducted by a bidirectional serial communication, etc. In the embodiment shown in FIG. 2, the fixing control section TS is connected to the whole control section S through a bidirectional serial communication line and a fixing drive permissible signal (an exclusive signal) s1 and to fixing heat source drive section 50*a* through a heat source drive signal (an exclusive signal) s2.

A control system in the main part of the image printing apparatus of the present invention will be described next with reference to FIG. 3.

The whole control section S of the image printing apparatus is constituted by a CPU as a main component and control units 200 to 600 connected to a connection system including a bus line, input/output (I/O) port, serial interface, and parallel interface. Each control operation is performed by executing a corresponding program stored in the memory.

Figure 3:
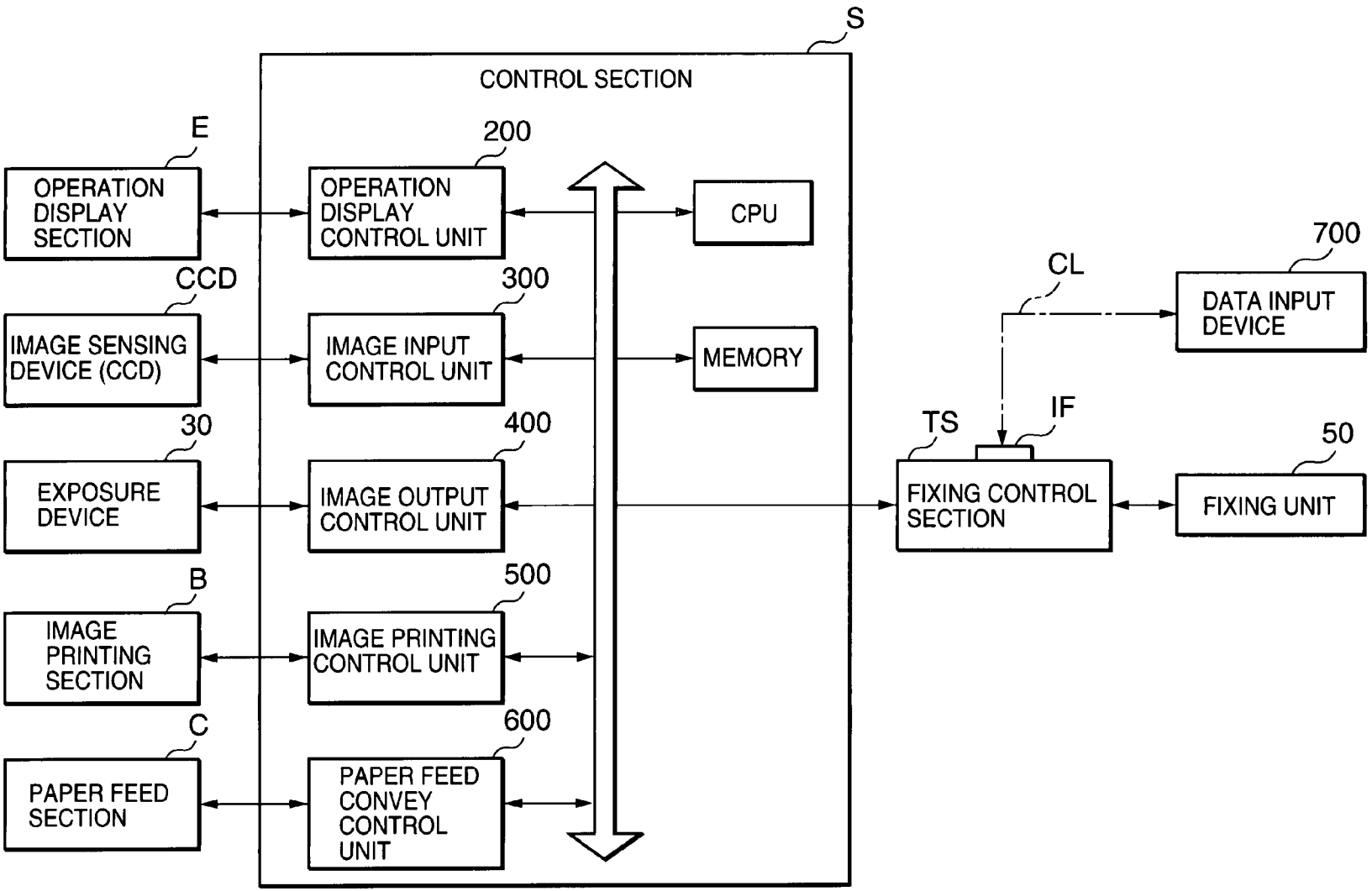
FIG. 3 is a block diagram showing a control system of a main part in the image printing apparatus of the present invention.

As shown in FIG. 3, in the embodiment of the present invention, the fixing control section (the engine control section) TS is provided with a communication interface IF for directly inputting external information associated with operation contents by using a data input device 700. The data input device 700 is provided independently of the fixing control section TS and is allowed to connect to the interface IF through a communication cable CL (indicated by the chain line in FIG. 3).

Note that as the above interface IF, an interface compatible with the data input device 700 may be used, including, for example, IEEE1284 and SCSI as parallel interfaces, and USB, EIA232, EIA422, and IEEE1394 as serial interfaces.

Figure 4:
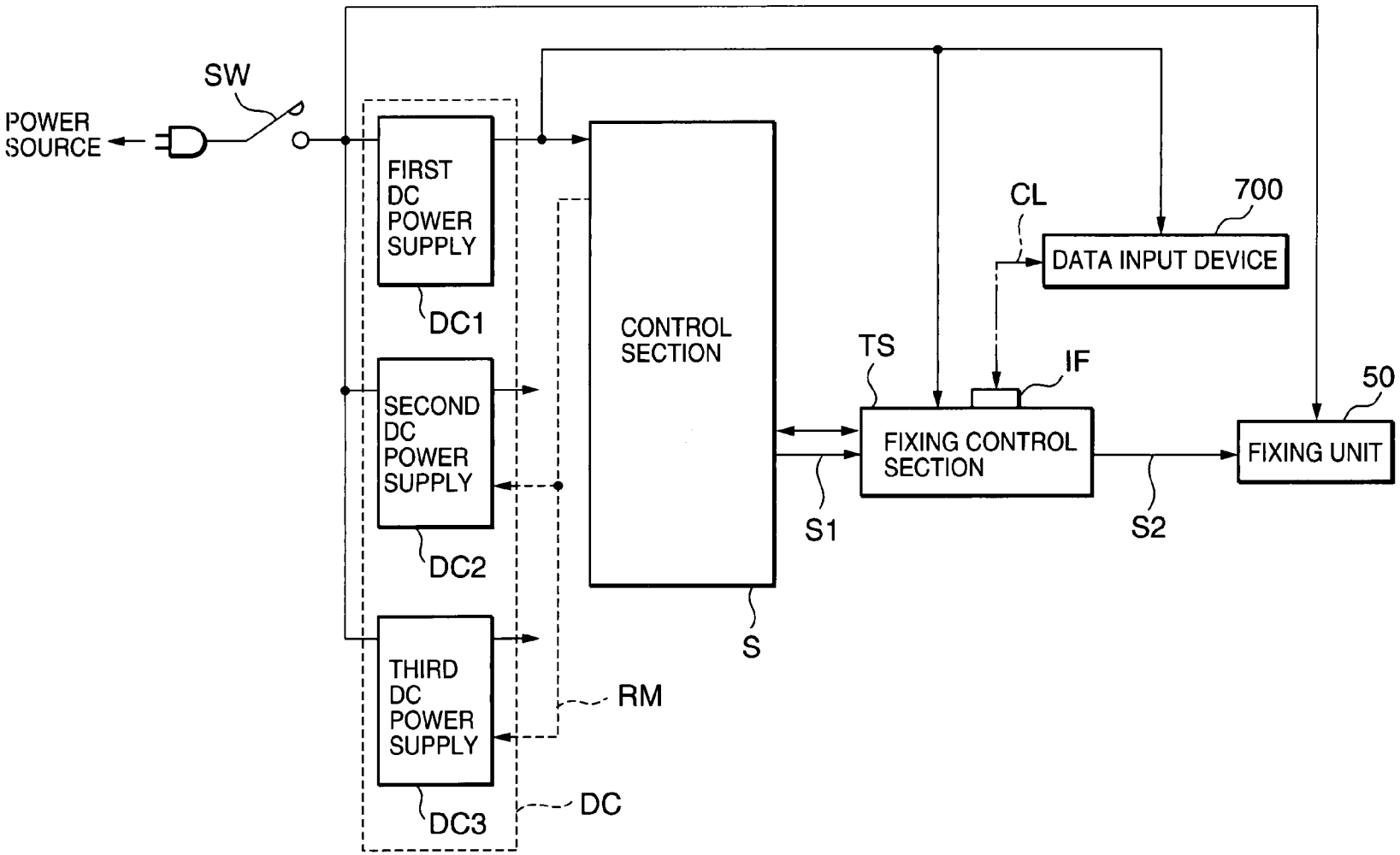
FIG. 4 is a block diagram showing the relationship of fixing control between the power supplies and the fixing control section in the image printing apparatus of the present invention.

FIG. 4 is a block diagram showing the relationship between power supplies of the image printing apparatus and the fixing control by the fixing control section.

When a power source switch SW is turned on, an AC voltage serving as a driving voltage is applied to a first DC power supply DC1, a second DC power supply DC2, a third DC power supply DC3, and a load driven by an AC voltage. The first DC power supply DC1 is a power supply for operating ICs mounted in the respective control units including the whole control section S, and is normally set at 5 V. The second DC power supply DC2 and third DC power supply DC3 are power supplies for driving loads which operate on DC voltages, or for various peripheral devices connected as options, and output, for example, voltages of 12 V, 24 V, and 48 V.

However, the load driven by an AC voltage is controlled to be kept in the OFF state. Therefore, no current flows in the load at the same time when the power source switch SW is turned on. In addition, the second DC power supply DC2 and third DC power supply DC3 output no voltage until a power control signal RM indicated by the dotted line in FIG. 4, which permits the power supplies to output voltages, is output from the whole control section S.

When the first DC power supply DC1 is started, a hard reset signal for the whole control section S is output first. Instructions for activating a program are then executed to download the program stored in the memory into a memory area for the execution of the program. The downloaded program is sequentially executed. At first, however, initialization is performed with reference to various set conditions to establish an initial state for a computer system. Upon completion of the initialization, the power control signal RM for permitting power output operation is output through the input/output (I/O) port. As a consequence, the second DC power supply DC2 and third DC power supply DC3 can output voltages.

The initialization is conducted by the whole control section S and includes such operations as decision of the start-up mode upon the ON state of the power source, a start-up operation of a built-in power source of the image printing apparatus, initializing of peripheral circuits of CPU, decompression of software, initial communications to various sections, etc.

In the present invention, a fixing control section TS determines, in accordance with information from the data input device 700, whether or not to energize the heater H of the fixing unit 50, and executes energization without waiting for an instruction from the whole control section S. This shortens the wait time between the instant at which the power source switch SW of the image printing apparatus is turned on and the instant at which energization of the heater H for heating the heating roller 51 of the fixing unit 50 is started. Further, in the maintenance and the manufacturing process, it becomes possible to deal with positively an inspecting work within the image printing apparatus. Under the circumstances, the operation whether or not to energize the heater H is decided after the initialization.

As described above, when the power source switch SW of the image printing apparatus is turned on, a preparation is made to supply AC power to the fixing unit 50 connected as a load. In addition, DC power is supplied from the first DC power supply DC1 to the fixing control section TS. This allows the fixing control section TS to start control operation without waiting for the completion of the processing operation at the start-up of the whole control section S. In addition, since DC power is supplied from the first DC power supply DC1 to the data input device 700, the fixing control section TS and data input device 700 can exchange data without waiting for the completion of processing operation at the start-up of the whole control section S.

Note that the fixing control section TS also has a microprocessor, which performs processing at start-up of the power supply. However, the program used in this case is much smaller than that used by the whole control section S, and hence the time required for this processing is negligibly short. The data input device 700 may have its own power supply, or may selectively use the first DC power supply DC1 and its own power supply, as needed.

Figure 5:
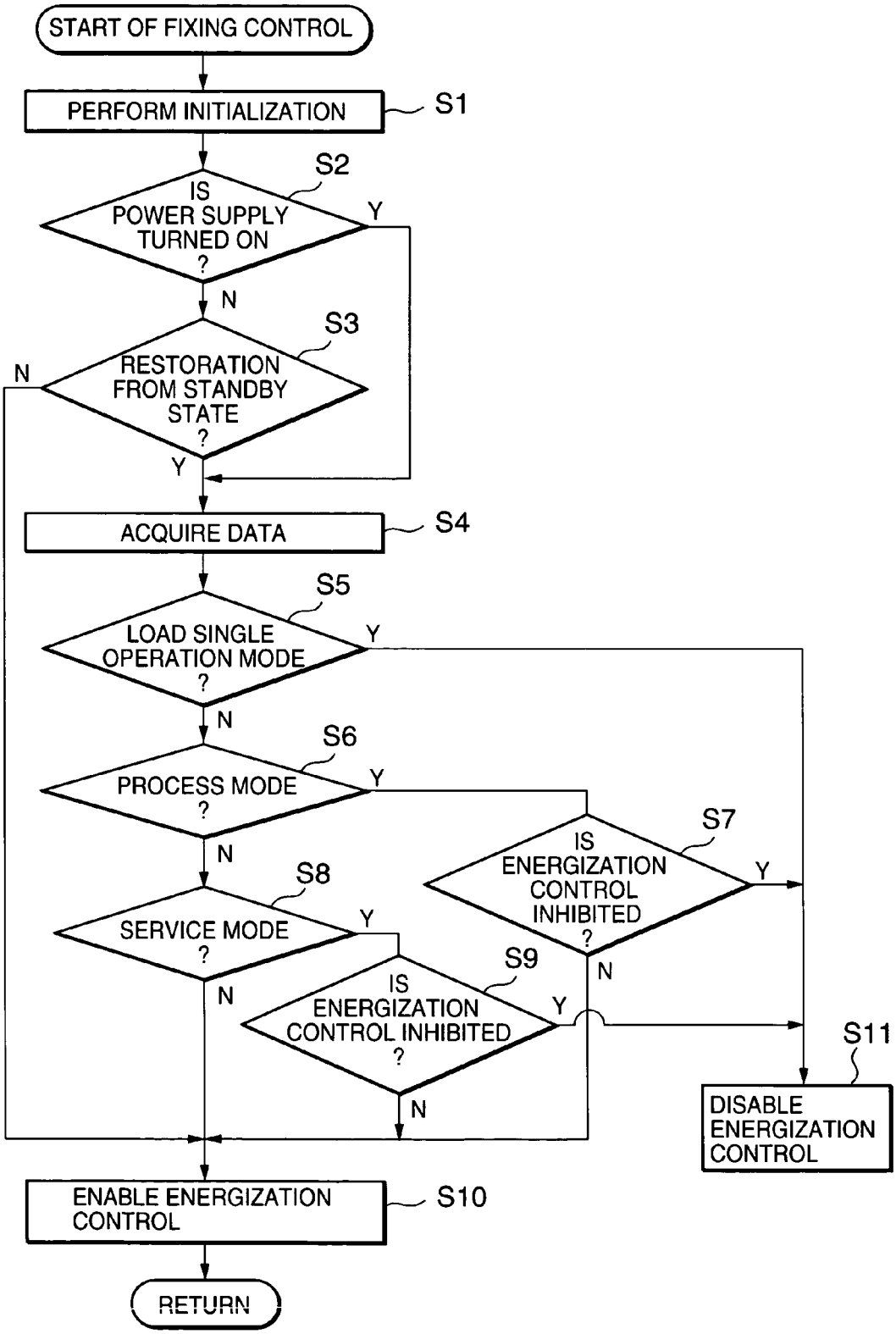
FIG. 5 is a flow-chart showing operation steps from start-up operation to energization control on a fixing unit, as a first control embodiment, in the image printing apparatus of the present invention.

In FIG. 5, as a first control operation example, a flow chart indicating the flow of operation from the instant at which the power supply of the image printing apparatus is turned on to the instant at which control operation of the fixing control section TS is started, which is based on energization of the heater H of the heating roller 51 of the fixing unit 50 and temperature detection by the temperature sensor 53 is shown.

When supply of power from the first DC power supply DC1 to the fixing control section TS is started, initialization processing is performed to perform hard reset and soft reset to the fixing control section TS and initialization (the step S1). Subsequently, the flow shifts to the processing based on the program.

The whole control section S is configured to send a signal indicating an incomplete state to the fixing control section TS until the start-up operation of itself is complete after the power source switch SW is turned on. Upon checking the signal (the step S2) and determining that the whole control section S is in the process of start-up operation, the fixing control section TS shifts to the step (S4) of acquiring data, which is instruction information for executing various kinds of operations, by sending a request signal to the data input device 700. If the whole control section S is not in the process of start-up, the flow shifts to the step (the step S3) of determining whether or not the whole control section S is restored from the standby state which is a low power consumption mode.

In the step S3, the fixing control section TS checks the state of the whole control section S to determine whether the whole control section S is restored from the standby state for power saving. If NO in the step S3, the fixing control section TS executes energization control on the fixing unit 50 (the step S10). If YES in the step S3, the flow advances to the step S4 of acquiring data from the data input device 700.

When the flow advances to the step of acquiring data from the data input device 700, it is determined first whether or not the mode of causing each operation section controlled by a corresponding control unit to operate separately is set (the step S5). If YES is obtained in this step, the flow advances to the step S11 of disabling energization control on the fixing unit 50. If NO is obtained in this step, the flow advances to the step of determining the next process mode.

If YES is obtained in the step S6 of checking whether or not the process mode is set, and the process mode is started, it is checked whether or not the contents of an instruction from the data input device 700 in the process mode indicate the inhibition of energization control on the fixing unit 50 (the step S7). If YES is obtained in this step, the flow advances to the step S11 of inhibiting energization control. If NO is obtained in this step, the flow advances to the step S10 of executing energization control.

Assume that NO is obtained in the step S5, and the service mode is set when YES is obtained in the step S8 of checking whether or not the service mode is set. In this case, it is checked whether or not the contents of an instruction from the data input device 700 in the service mode indicate the inhibition of energization control on the fixing unit 50 (the step S9). If YES is obtained in this step, the flow advances to the step S11 of inhibiting energization control. If NO is obtained in this step, the flow advances to the step S10 of executing energization control.

As is obvious from the above description, according to the first control operation example of the present invention, the fixing control section TS can start energization control on the fixing unit 50 without waiting for processing at start-up of the whole control section S. In addition, in this case, whether or not energization control is executed can be designated by input operation using the data input device 700 connected through a communication unit.

Figure 6:
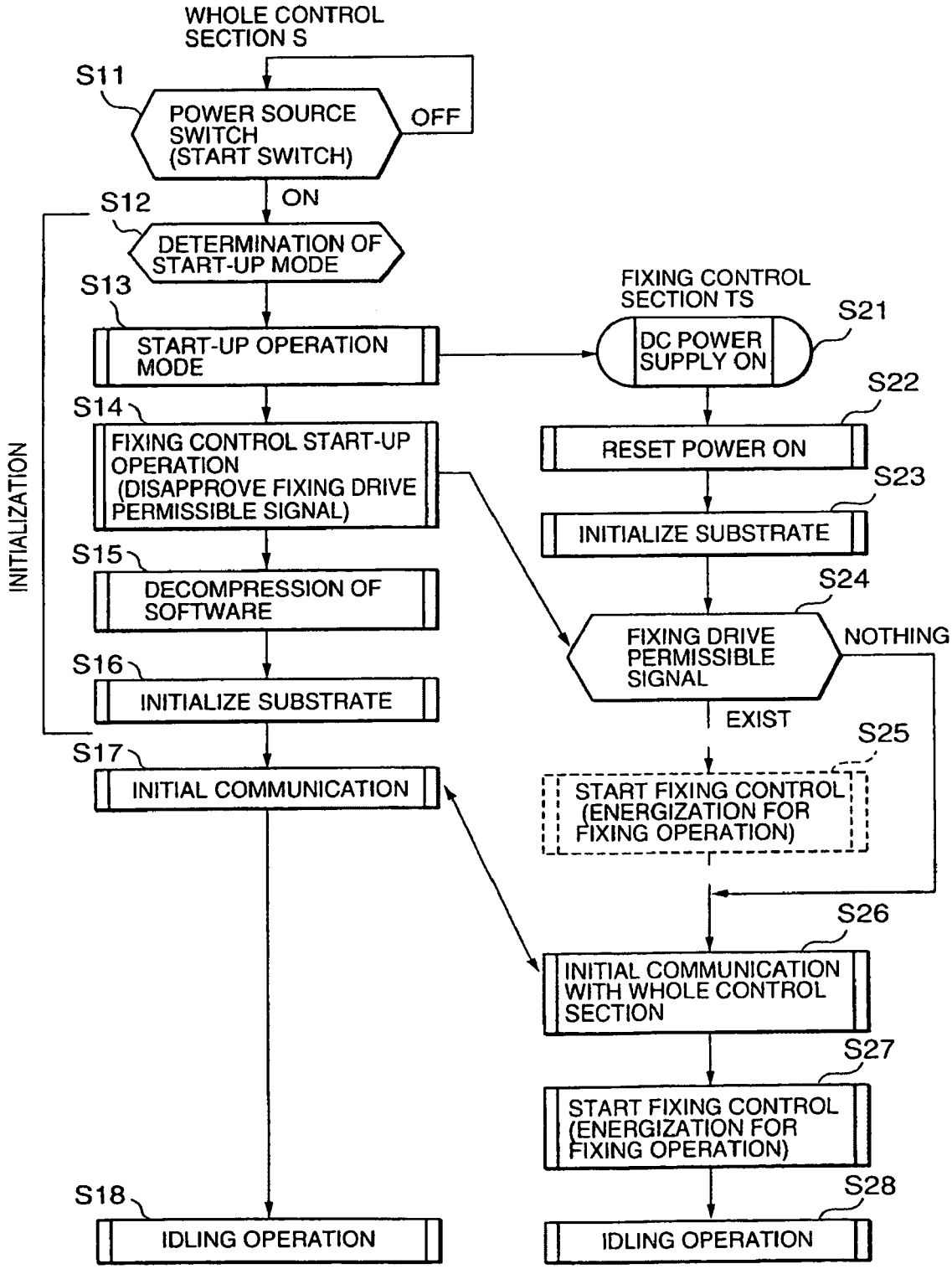
FIGS. 6 and 7 are flow-charts showing second and third control embodiments, respectively, in the image printing apparatus of the present invention.

Next, a second control operation example is explained by making reference to an operation flow shown in FIG. 6.

The operation flow shown in FIG. 6 indicates a case such that the whole control section S and the fixing control section TS are controlled by their individual CPUs and that the fixing control (energization for the fixing operation) is started after the initialization in the whole control section S.

As is apparent from the operation flow shown in FIG. 6, a determination whether early energization for the fixing operation is approved or disapproved is made (step S12)

after the start switch SW is in the ON state in the step S11. As a result, when the early energization is determined to be disapproved, the fixing drive permissible signal s1 is set as "nothing" in the step S24 (a determination routine of the fixing drive permissible signal s1) at the fixing control section TS, thereby skipping the fixing control in the step S25. Accordingly, an initial communication is conducted between the fixing control section TS and the whole control section S (the steps S17 and S26). On the other hand, in the meantime, the initialization (the steps S12–S16) is conducted in the whole control section S. After the initialization, the fixing control is started in the fixing control section TS (the step S27). Prior to the step S24, steps S21 to S23 are performed. Further, after the steps S17 and S27, respective idling operations of the whole control section S and the fixing control section TS are performed (steps S18 and S28), and, at this time, the preparation for printing is completed. It is noted that the steps S12–S16 in the initialization at the whole control section S can be conducted in an order different from the order shown.

Figure 7:
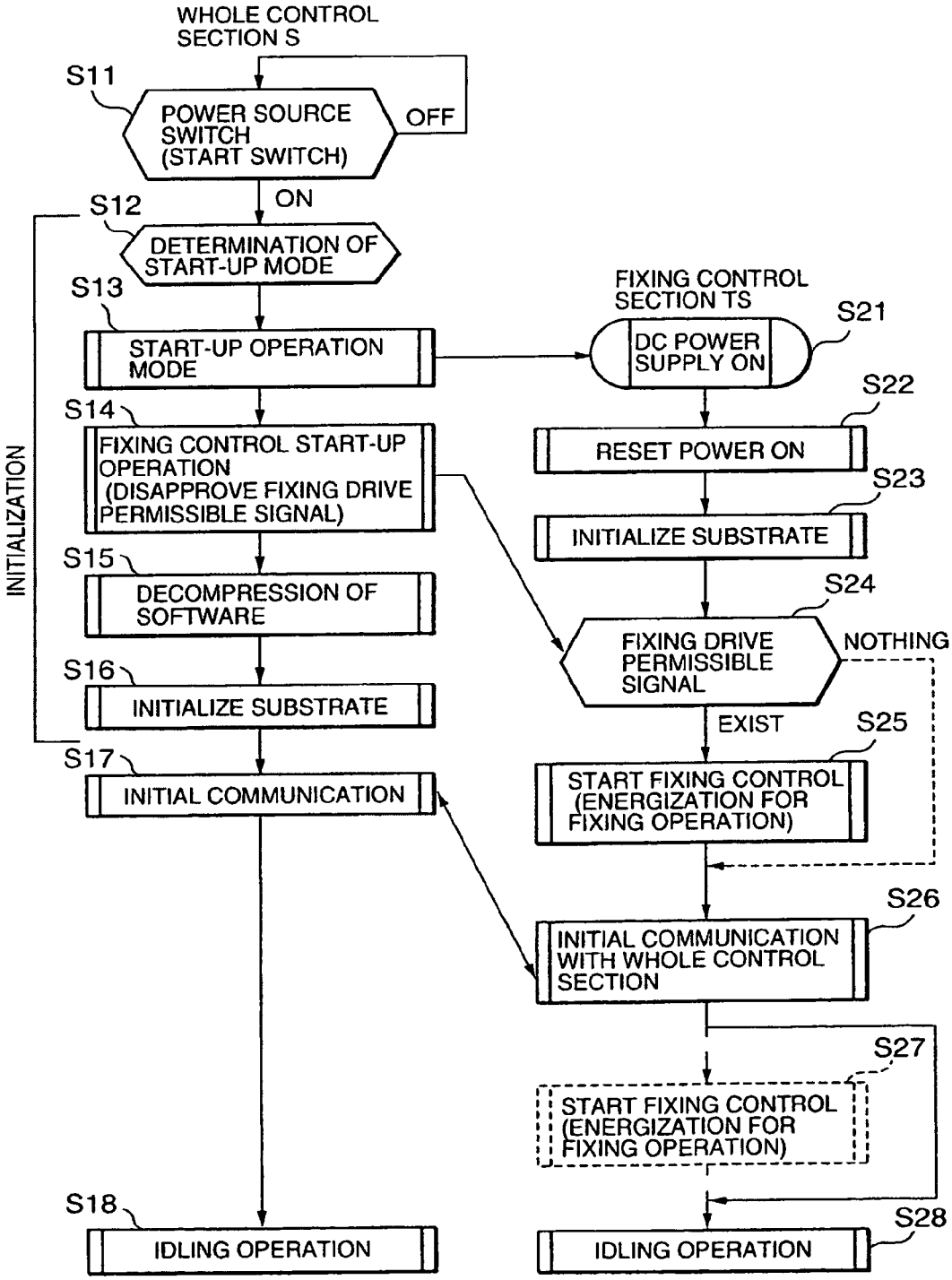

In the last place, a third control operation example is explained by making reference to an operation flow shown in FIG. 7. Description of overlapped portions in the operation flow shown in FIG. 6 is omitted.

The operation flow shown in FIG. 7 indicates a case such that the whole control section S and the fixing control section TS are controlled by their individual CPUs and that the fixing control (energization for the fixing operation) is started before the initialization in the whole control section S.

As is apparent from the operation flow shown in FIG. 7, when the early energization is determined to be approved in the step S12, the fixing drive permissible signal s1 is set as "exist" in the step S24 (a determination routine of the fixing drive permissible signal s1) at the fixing control section TS. As a result, before the initialization, the fixing control is conducted in the fixing control section TS (the step S25). Thereafter, the initial communication is conducted between the fixing control section TS and the whole control section S (the step S26). In this case, it should be noted that the fixing control in the step S27 is skipped.

In the embodiment of the present invention, for the sake of descriptive convenience, an operation display section E and the data input device 700 are handled as totally different devices. However, the operation display section E may incorporate the function of the data input device 700.

What is claimed is:

1. An image printing apparatus, comprising:

a fixing unit which fixes a toner image transferred on a paper sheet to the paper sheet by applying pressure and heat, a fixing control unit which controls the fixing unit, and an image printing control unit which controls printing of the toner image, wherein the fixing unit has:

a first operation mode for starting energization of the fixing unit after an initialization in the image printing control unit is completed; and a second operation mode for starting energization of the fixing unit before the initialization in the image printing control unit is completed.

2. An apparatus as described in claim 1, wherein either one of the two operation modes is performed at at least one of a time when an electric power source of the image printing apparatus is turned on and a time of returning from a stand-by state, which is a low power consumption mode.

3. An image printing apparatus, comprising:

a fixing unit which fixes a toner image transferred on a paper sheet to the paper sheet by applying pressure and heat, a fixing control unit which controls the fixing unit, an image printing control unit which controls printing of the toner image, and an interface which is mounted on the fixing unit and is capable of receiving data from a data input unit, wherein the fixing unit has:

a first operation mode for starting energization of the fixing unit by making reference to the data received through the interface from the data input unit after an initialization in the image printing control unit is completed; and a second operation mode for starting energization of the fixing unit before the initialization in the image printing control unit is completed.

4. An apparatus as described in claim 3, wherein either one of the two operation modes is performed at at least one of a time when an electric power source of the image printing apparatus is turned on and a time of returning from a stand-by state, which is a low power consumption mode.

5. An apparatus as described in claim 3, wherein the data input unit is provided independently of the fixing unit and is connectable to the interface through a communication cable.

6. An apparatus as described in claim 3, wherein the data input unit is mounted in an operation/display section of the image printing apparatus.

7. An apparatus as described in claim 3, wherein the data inputted by the data input unit includes pieces of information related to at least one of: a load individual operation mode, a process mode used in a manufacturing process, and a service mode used in after-sale servicing.

8. An image printing apparatus, comprising:

a fixing unit which fixes a toner image transferred on a paper sheet to the paper sheet by applying pressure and heat, a fixing control unit which controls the fixing unit, an image printing control unit which controls printing of the toner image, and an interface which is mounted on the fixing unit and is capable of receiving data from a data input unit, wherein the fixing unit has:

a first operation mode for judging whether or not starting energization of the fixing unit after an initialization in the image printing control unit is completed; and a second operation mode for judging whether or not starting energization of the fixing unit before the initialization in the image printing control unit is completed.

9. An apparatus as described in claim 8, wherein either one of the two operation modes is performed at at least one of a time when an electric power source of the image printing apparatus is turned on and a time of returning from a stand-by state, which is a low power consumption mode.

10. An apparatus as described in claim 8, wherein the data input unit is provided independently of the fixing unit and is connectable to the interface through a communication cable.

11. An apparatus as described in claim 8, wherein the data input unit is mounted in an operation/display section of the image printing apparatus.

12. An apparatus as described in claim 8, wherein the data inputted by the data input unit includes pieces of information related to at least one of: a load individual operation mode, a process mode used in a manufacturing process, and a service mode used in after-sale servicing.

* * * * *